US009671109B2

(12) United States Patent
Hamilton

(10) Patent No.: US 9,671,109 B2
(45) Date of Patent: Jun. 6, 2017

(54) CHIMNEY CLEANER

(71) Applicant: Linwood F. Hamilton, Charleston, WV (US)

(72) Inventor: Linwood F. Hamilton, Charleston, WV (US)

( * ) Notice: Subject to any disclaimer, the term of this patent is extended or adjusted under 35 U.S.C. 154(b) by 0 days.

(21) Appl. No.: 14/883,683

(22) Filed: Oct. 15, 2015

(65) Prior Publication Data

US 2017/0106414 A1 Apr. 20, 2017

(51) Int. Cl.
*F23J 3/02* (2006.01)
*B08B 9/043* (2006.01)

(52) U.S. Cl.
CPC ..... *F23J 3/026* (2013.01); *B08B 9/0436* (2013.01)

(58) Field of Classification Search
CPC ..... F23J 3/02; F23J 3/026; B08B 9/00; B08B 9/02; B08B 9/027; B08B 9/04; B08B 9/043; B08B 9/0436
USPC ..... 15/249.1–249.3, 104.066–104.069
See application file for complete search history.

(56) References Cited

U.S. PATENT DOCUMENTS 739,435 A * 9/1903 Melcher ..... F23J 3/026 15/104.067
1,030,733 A * 6/1912 Johnston ..... F23J 3/026 15/159.1
1,297,090 A * 3/1919 Campbell et al. ..... F23J 3/026 15/249.1
1,320,887 A * 11/1919 Michels, Sr ..... F23J 3/026 15/249.3
1,725,980 A * 8/1929 Fahrenbach ..... F23J 3/026 15/104.067
4,365,382 A * 12/1982 Korfmann ..... F23J 3/026 15/249.3
4,543,681 A * 10/1985 Ryden ..... F23J 3/026 15/249.1
4,573,232 A * 3/1986 Marley ..... F23J 3/026 15/249.1
4,583,258 A * 4/1986 Carroll ..... F23J 3/026 15/104.069
4,807,320 A * 2/1989 Labrecque ..... F23J 3/026 15/249.1
4,964,921 A * 10/1990 Lloyd ..... F23J 3/026 134/21

FOREIGN PATENT DOCUMENTS

DE 455487 * 2/1928
DE 3229245 * 5/1984
DE 3242786 * 5/1984

* cited by examiner

*Primary Examiner* — Mark Spisich

(57) ABSTRACT

A chimney cleaner that is conveniently installed within a chimney liner is described. In some embodiment, the chimney cleaner is integrated with the chimney cap that may be used to replace existing chimney caps. The chimney cleaner utilizes a cleaner tool affixed to a cable such that the cleaner tool may be raised and lowered within the chimney liner by shortening or lengthening the cable.

6 Claims, 1 Drawing Sheet

CHIMNEY CLEANER

BACKGROUND OF THE INVENTION

The chimney of a fireplace contains a build up of burned organic matter over time that accumulates in the chimney or chimney liner of a fireplace. The build up of organic matter within the chimney liner presents a fire hazard to the overall structure and must be cleaned out or otherwise removed from time to time. Typically, a chimney sweep service is scheduled to manually clean and clear the chimney liner of organic matter.

SUMMARY OF THE INVENTION

Embodiments of the present invention are directed to an integrated chimney cap and chimney cleaner. In certain embodiments, a chimney cleaner for cleaning a chimney liner, the chimney cleaner may comprise a cleaner tool connected to a cable and a cable guide, wherein the cable guide is adapted to substantially center the cleaner tool across the diameter of a chimney liner. The cleaner tool may be a rake or a brush. In some embodiments, cleaner tool is removably affixed to the cable.

Additionally an electric wench may be connected to the cable and adapted to raise and lower the cleaner tool within the chimney liner. In additional embodiments, the cable may be selected from the group consisting of braided steel cable and twisted steel cable. Still further, in some embodiments, the cable guide and cable may be integrated with a chimney cap. In additional embodiments, a removable chimney cleaner may include a cleaner tool removably connected to a cable, a cable guide affixed to a chimney cap, wherein the cable guide is adapted to substantially center the cleaner tool across the diameter of a chimney liner, and a cable conduit passing through a weather shield of the chimney cap, wherein the cable passes through the cable conduit, and wherein the chimney cap is adapted to be removably affixed to a chimney liner.

DETAILED DESCRIPTION OF EMBODIMENTS OF THE INVENTION

Embodiments of the invention is directed to a chimney cleaner that is integrated with a chimney cap to allow for instant and frequent cleaning of the chimney or chimney liner. Most modern wood burning fireplaces have a chimney liner that is made from tile, metal, or is cast-in-place. As used herein, "chimney liner" refers to the internal passage of the chimney in which exhaust gases from the wood burning fireplace travel and exit the building. The chimney cleaner is easily adaptable to virtually any residential chimney by replacing the chimney cap with an integrated chimney cleaner and chimney cap in accordance with certain embodiments of present invention.

Figure 1:
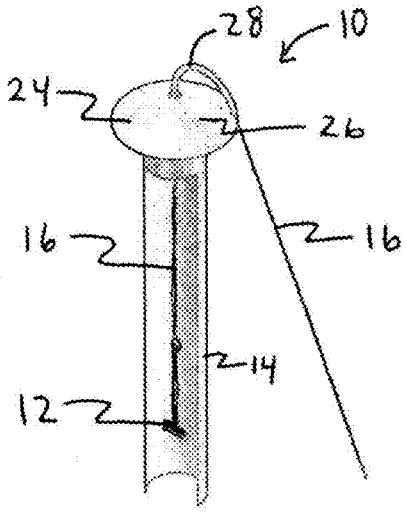
FIG. 1 is a diagrammatic view of a chimney cleaner in accordance with an embodiment of the invention where a portion of the chimney liner has been removed for illustration.
Figure 2:
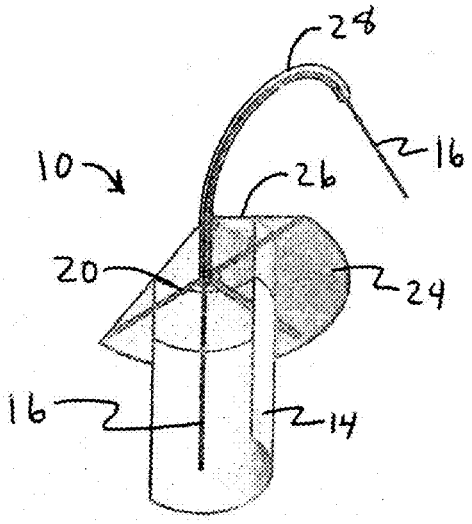
FIG. 2 is a cross-sectional view of a chimney cleaner in accordance with an embodiment of the present invention.
Figure 3:
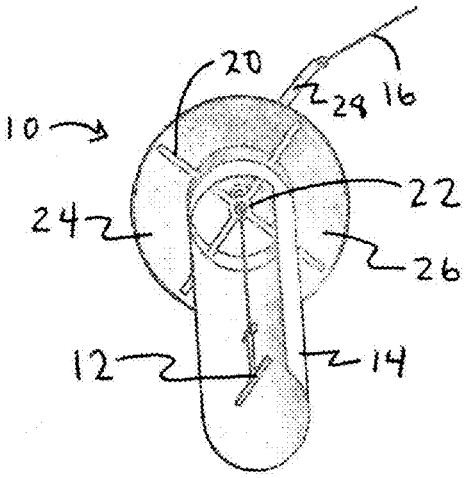
FIG. 3 is a diagrammatic bottom perspective view of a chimney cleaner in accordance with an embodiment of the invention where a portion of the chimney liner has been removed for illustration.

With reference to FIGS. 1-3, there is illustrated a chimney cleaner 10 in accordance with an embodiment of the invention. The chimney cleaner 10 includes a cleaner tool 12 that is sized to fit within the chimney liner 14. The cleaner tool is configured to contact sides of the chimney liner 14 to dislodge organic matter build up within the chimney liner. In some embodiments, the cleaner tool 12 may be in the form of a rake or brush. The weight and strength of the cleaner tool 12 is not particularly limited but should have enough weight and strength to facilitate the break up organic matter build up on the walls of the chimney liner 14 when the cleaning tool 12 contacts the organic matter build up.

The cleaner tool 12 is attached to a cable 16. In some embodiments, the cleaner tool 12 is removably affixed or attached to the cable 16 such that different types cleaner tools may be interchanged with one another if desired. The cable 16 extends from the cleaner tool 12 to a top portion of the chimney liner 14. The cable 16 is preferably constructed from a material that can withstand the temperatures and conditions within the chimney liner 14 during operation of the fireplace. In some embodiments, the cable 16 may include, but is not limited to, braided steel cable, twisted steel cable, and polymer rope. The length of the cable 16 is sized to lift the cleaner tool 12 along the length chimney liner 14. Preferably, the length of the cable 16 is sized to lift the cleaner tool 12 from the base of the chimney liner to the top of the chimney liner. In some embodiments, the length of the cable 16 is sized to lift the cleaner tool 12 from the base of the chimney liner 14 to the top of the chimney liner 14 by a person at ground level with the building. In other embodiments, an electric motor or electric cable wench (not shown) may be used to wind and unwind the cable 16 to automatically raise and lower the cleaner tool 12 in the chimney liner 14. The position of the motor or cable wench is not critical and may be positioned near the chimney cap or near the ground based on the preference of the user.

As illustrated in FIG. 2, some embodiments include a cable guide 20. The cable guide 20 is adapted to substantially center the cable 16 across the diameter of the chimney liner 14. In some embodiments, the cable 16 passes through a cable guide ring 22 of the cable guide 20, where the cable guide ring 22 may be substantially centered across the diameter of the chimney liner 14. The position of the cable guide 20 is not particularly limited, but is preferably positioned near the top portion of the chimney liner. The cable guide 20 may be positioned above the chimney liner 14 and near the weather shield 24 of the chimney cap 26. In some embodiments a cable conduit 28 may be provided through the chimney cap 26 to allow the cable 16 to exit the chimney cap 26. In this way the cable 16 exits the chimney liner 14, passes through the cable guide 20, passes through the cable conduit 28 to exit the chimney cap 26 through the weather shield 24.

In some embodiments, the chimney cleaner 10 and chimney cap 26 are integrated together as a single unit that may be installed as a replacement or removable chimney cap. Alternatively, in some embodiments, the chimney cleaner 10 may be installed with exiting chimney caps provided that a pathway for the cable 16 is created to allow the cable 16 to exit the existing chimney cap. In some embodiments the chimney cap may be integrally formed with the chimney liner as shown in FIG. 1. Alternatively, the chimney cleaner 10 may have an extension similar to the illustrated chimney liner in FIG. 1 that is shorter in length and is adapted to fit within an existing chimney liner.

In operation, the user installs the cleaner tool 12 of choice and then raises and lowers the cleaner tool within the chimney liner 14 by pulling and releasing or winding and unwinding the cable 16 to break free any build up of organic material in the chimney liner 14. It is not necessary to remove the cleaner tool 12 after cleaning is finished. The cleaner tool 12 may stay attached to the cleaner cable 16 during operation of the fireplace. If the cleaner tool does not significantly restrict air flow and operation of the fireplace, the storage position of the cleaner tool is not particularly limited. If the cleaner tool 12 is in the form of a brush or other similar tool that does restrict air flow, the cleaner tool 12 is preferably stored near the weather shield and above the exit of the chimney liner.

Having described embodiments of the invention in detail above, the present invention is limited only by the appended claims.

What is claimed is:

1. A chimney cleaner for cleaning a chimney liner, the chimney cleaner comprising:

a removable cleaner tool connected to a cable;

a cable guide, wherein the cable guide is adapted to substantially center the cleaner tool across the diameter of a chimney liner;

a chimney cap;

a cable conduit extending through the chimney cap such that a first portion thereof extends from an exterior of the cap and a second portion extends into an interior of the cap to the cable guide; and an extension similar to a chimney liner which is shorter in length than the chimney liner and adapted to fit within the chimney liner, wherein the removable cleaner tool, cable guide, extension and chimney cap are integrated together as a single unit.

2. The chimney cleaner of claim 1, wherein the removable cleaner tool is a rake.

3. The chimney cleaner of claim 1, wherein the removable cleaner tool is a brush.

4. The chimney cleaner of claim 1, further comprising an electric wench connected to the cable and adapted to raise and lower the removable cleaner tool within the chimney liner.

5. The chimney cleaner of claim 1, wherein the cable is selected from the group consisting of braided steel cable and twisted steel cable.

6. The chimney cleaner of claim 1, wherein the cable guide comprises a cable guide ring.

* * * * *